US005215248A

United States Patent [19]

Moser

[11] Patent Number: 5,215,248

[45] Date of Patent: Jun. 1, 1993

[54] COLLAPSIBLE SHIPPING CARTON

[75] Inventor: Paul Moser, Milford, Conn.

[73] Assignee: Hexacomb Corporation, Lincolnshire, Ill.

[21] Appl. No.: 954,463

[22] Filed: Sep. 30, 1992

Related U.S. Application Data

[63] Continuation of Ser. No. 759,936, Sep. 16, 1991, abandoned, which is a continuation of Ser. No. 453,372, Dec. 22, 1989, abandoned, which is a continuation-in-part of Ser. No. 291,524, Dec. 29, 1988, abandoned.

[51] Int. Cl.[5] ..... B65D 5/32; B65D 5/56

[52] U.S. Cl. ..... 229/23 R; 206/600; 220/441; 229/23 A; 493/84

[58] Field of Search ..... 220/415, 418, 441, 464, 220/468; 229/23 R, 23 A, 23 C, DIG. 4; 206/386, 600; 493/84

[56] References Cited

U.S. PATENT DOCUMENTS

| | | | |
|---|---|---|---|
| 2,001,632 | 5/1935 | Schlichting | 154/45 |
| 2,180,338 | 11/1939 | Cloud | 93/1 |
| 2,556,470 | 6/1951 | Del Mar | 154/44 |
| 2,609.068 | 9/1952 | Pajak | 189/34 |
| 2,670,314 | 4/1948 | Ungar | 154/117 |
| 2,756,496 | 7/1956 | Holland | 29/455 |
| 2,766,923 | 10/1956 | D'Esposito | 229/23 C |
| 2,770,406 | 11/1956 | Lane | 229/3.5 R |
| 2,780,402 | 2/1957 | Zucker et al. | 229/109 |
| 2,794,588 | 6/1957 | George et al. | 220/415 |
| 2,797,447 | 12/1957 | Winer | 20/15 |
| 2,828,235 | 3/1958 | Holland et al. | 154/118 |
| 2,833,004 | 5/1958 | Johnson et al. | 20/91 |
| 2,887,241 | 5/1959 | MacKenzie | 229/23 C |
| 2,925,210 | 2/1960 | Fallert | 229/23 A |
| 2,932,438 | 4/1960 | Smith | 220/441 |
| 2,952,579 | 9/1960 | Merriman | 154/127 |
| 3,224,924 | 12/1965 | Von Ardenne et al. | 161/68 |
| 3,391,056 | 7/1968 | Robinson | 161/232 |
| 3,509,005 | 4/1970 | Hartig | 229/3.5 R |
| 3,607,518 | 9/1971 | Ellinor | 156/197 |
| 3,637,448 | 1/1972 | Siegal et al. | 156/197 |
| 3,642,550 | 2/1972 | Doll | 229/3.5 R |
| 3,650,871 | 3/1972 | Bentfors | 156/269 |
| 3,659,772 | 5/1972 | Dorsey et al. | 229/DIG. 4 |

(List continued on next page.)

FOREIGN PATENT DOCUMENTS

| | | | |
|---|---|---|---|
| 490592 | 2/1953 | Canada | 229/23 R |
| 20171 | 12/1980 | European Pat. Off. | 229/23 R |
| 208946 | 11/1966 | Sweden | 428/192 |
| 893587 | 1/1982 | U.S.S.R. . | |

OTHER PUBLICATIONS

U.S. application Ser. No. 266,017, Hollander et al, Nov. 2, 1988.

Product Bulletin Data Sheet 109—"Protective Inner Packaging," Published by Honeycomb Structural Products, Inc. La Mirada, (2 pages).

Product Bulletin Data Sheet 111—"Kraft Paper Honeycomb," Published by Honeycomb Structural Products, Inc., La Mirada, Calif. (2 pages).

Product Literature on File Cabinet Pack of International Honeycomb Corporation.

Invoices on Tuna Box from Volk Packaging Corporation.

Astro-Foil TM product literature from AVI Astro-Valcour, Inc.

Distribution Packaging by Friedman & Kipnees, pp. 117-119 (1977).

*Primary Examiner*—Gary E. Elkins

*Attorney, Agent, or Firm*—Olson & Hierl, Ltd.

[57] ABSTRACT

A shipping carton includes a plurality of generally rectangular panels with a hinge between at least each two adjacent panels. The panels can be extended and placed at about right angles from each other to form a sidewall having an open top portion and an open bottom portion. A pair of support trays each comprising a panel member and four side members that extend therefrom fit over the portion bottom and top portion of the sidewall to enclose the carton. In a preferred embodiment, spaced-apart inserts and liner members can be provided which fit within each support tray. The panels and the support trays are secured to prepare the carton for shipping.

47 Claims, 2 Drawing Sheets

U.S. PATENT DOCUMENTS

| | | | |
|---|---|---|---|
| 3,753,843 | 8/1973 | Hutchinson | 161/43 |
| 3,789,094 | 1/1974 | Hutchinson | 264/45 |
| 3,866,523 | 2/1975 | Geschwender | 493/19 |
| 4,048,366 | 4/1978 | Saylor et al. | 52/615 |
| 4,083,159 | 4/1978 | Hatch et al. | 52/309.1 |
| 4,166,567 | 9/1979 | Beach, Jr. et al. | 229/41 C |
| 4,194,313 | 3/1980 | Downing | 40/610 |
| 4,353,947 | 10/1982 | Northcutt | 428/116 |
| 4,382,106 | 5/1983 | Royster | 428/40 |
| 4,392,606 | 7/1983 | Fremion | 206/600 |
| 4,434,890 | 3/1984 | Sieck et al. | 229/3.5 MF |
| 4,454,946 | 6/1984 | Yokowo | 206/600 |
| 4,461,796 | 7/1984 | Fukahori et al. | 428/116 |
| 4,465,725 | 8/1984 | Riel | 428/116 |
| 4,548,351 | 10/1985 | Gusic | 220/441 |
| 4,601,407 | 7/1986 | Gillard | 229/DIG. 4 |
| 4,606,461 | 8/1986 | Bolton, Sr. | 229/41 B |
| 4,606,959 | 8/1986 | Hillinger | 428/116 |
| 4,682,708 | 7/1987 | Pool | 220/468 |
| 4,691,859 | 9/1987 | Snyder | 229/41 R |
| 4,749,601 | 6/1988 | Hillinger | 428/73 |

10
12
14
16
18
20
22
24
26
28
30
32
34
36
38
40
42
44
46
48
50
52
54

COLLAPSIBLE SHIPPING CARTON

CROSS REFERENCE TO PREVIOUS APPLICATION

This application is a continuation of application Ser. No. 07/759,936, filed Sep. 16, 1991, now abandoned. Application Ser. No. 07/759,936 is a continuation of application Ser. No. 07/453,372, filed Dec. 22, 1989, now abandoned. Application Ser. No. 07/453,372 is a continuation-in-part of application Ser. No. 291,524 filed Dec. 29, 1988, now abandoned.

TECHNICAL FIELD OF THE INVENTION

The present invention relates to packaging systems and specifically to shipping cartons which can be collapsed for efficient storage.

BACKGROUND OF THE INVENTION

The difficulty of safely transporting sensitive products including perishable food items has been a common problem in the shipping industry. Many different approaches for shipping such goods have been proposed. Each approach, however, has a number of drawbacks.

For example, the oldest and simplest method for shipping perishable goods involves the use of insulated blankets or pads and careful handling. This method, although relatively inexpensive, is usually unsatisfactory because the pads do not adequately protect and insulate the goods. Moreover, careful handling is a labor intensive and thus costly process.

Another method involves the use of wood panels or crating to reinforce shipping cartons. This approach, however, considerably increases shipping costs. The production of crates is also a labor intensive process and the weight of wood-containing packaging systems significantly increases shipping costs.

Still another approach is the use of insulating panels inserted against the inner surface of each side of a carton. This most recent approach is often difficult to use because the insulating panels and the products must be carefully lifted and placed into the carton. This step increases both time and labor costs.

There is a need for packaging that is inexpensive to manufacture and use, collapsible for efficient storage and provides adequate protection for the products being shipped.

SUMMARY OF THE INVENTION

The present invention relates to a shipping carton which is reinforced and insulated to provide a useful means for the safe transport of goods. In addition, the carton can be provided as a packaging kit which can be collapsed for efficient storage.

A plurality of generally rectangular panels includes hinge means between at least a pair of adjacent panels to form a collapsible sidewall. When the panels are extended and each panel is positioned at a right angle to an adjacent panel, the sidewall formed by the panels defines a box-like structure having an open top portion and an open bottom portion. Each panel can be formed of a honeycomb-type material and can be laminated with foil material to enhance its insulating properties. In the alternative, each panel can be formed of an expanded polystyrene foam which can also be laminated with a metal foil material.

An upper support tray and a lower support tray are provided to receive the sidewall and to fit over the top portion and bottom portion, respectively, of the box-like structure defined by the sidewall. Each support tray includes a panel member having an inside surface and four side members which extend at right angles from the inside surface about the perimeter of the panel member. The support trays are adapted to receive the sidewall upon placement over the top or bottom portion of the box-like structure to provide an enclosed shipping carton. A removable liner member can be provided adjacent and in association with the inside surface of one or both support trays.

A plurality of upper and lower inserts is provided along the inside surface of one or both of the support trays between the support tray and the removable liner. The inserts reinforce the support tray and provide a space between the liner and support tray and between adjacent inserts for further insulation by reducing the area which conducts heat.

Each insert comprises an elongate member with a pair of generally flat surfaces. In a preferred embodiment, one surface of the elongate member is firmly secured to the inside surface of a support tray. During assembly, a removable liner member is placed within the upper or lower support tray against the second surfaces of the inserts. In an alternative embodiment, the second surface includes an adhesive means for releasably engaging the liner member. The adhesive means preferably includes a removable backing layer. Securing means such as strapping, banding or tape can be provided to maintain the box-like configuration for shipping.

The present invention thus provides a shipping carton which is reinforced to protect the product being shipped and which can be insulated for the shipment of perishable goods. The carton can be collapsed for efficient storage and can be provided as a packaging kit.

DETAILED DESCRIPTION OF A PREFERRED EMBODIMENT

Figures 1, 2, 3:
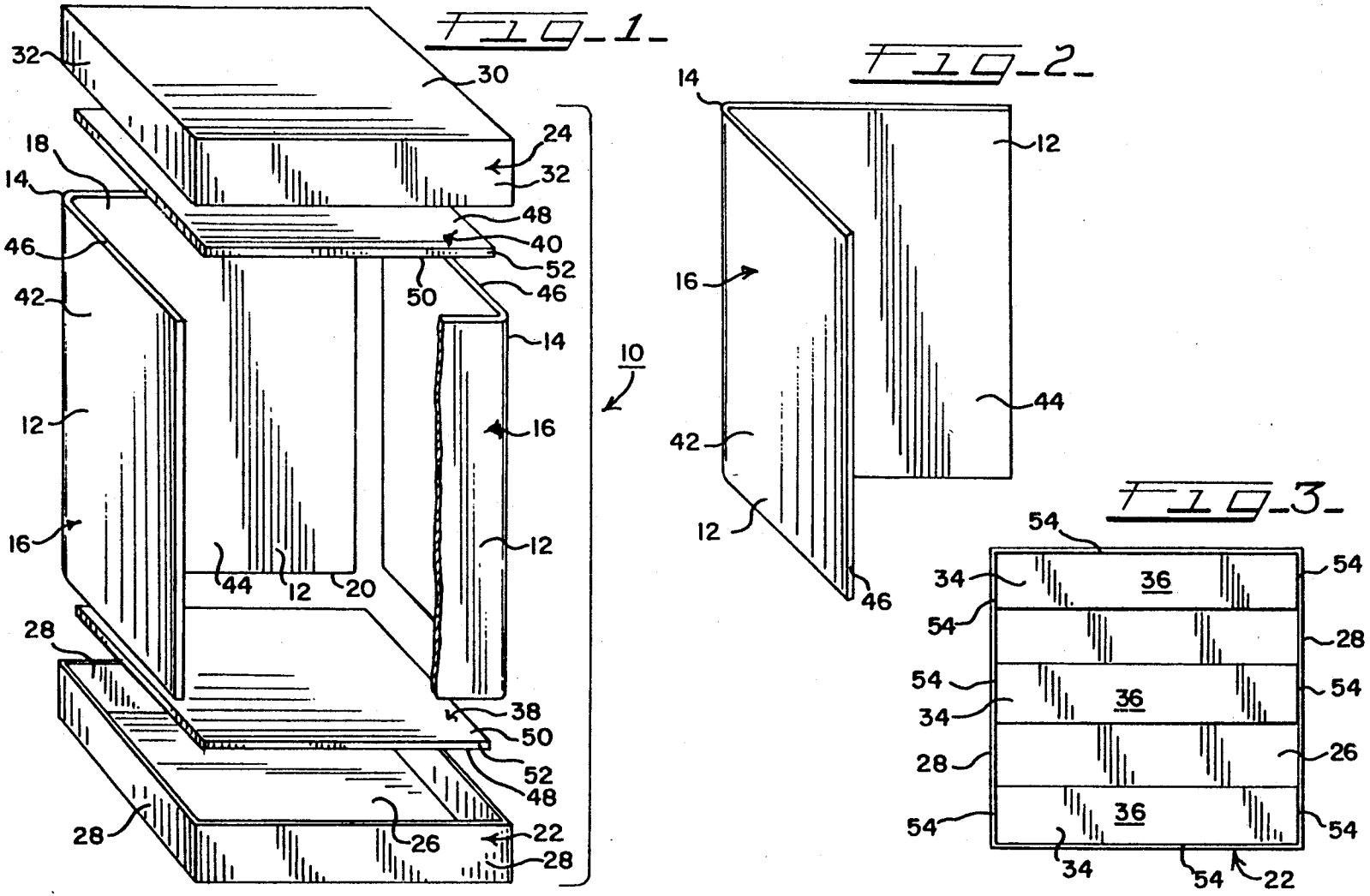
FIG. 1 is an exploded perspective view of an embodiment of the carton of the present invention with a partial cut-away view of a collapsible sidewall.
FIG. 2 is a perspective view of one of the two collapsible sidewalls shown in FIG. 1.
FIG. 3 is a top view of the support tray of FIG. 1.

Referring to FIG. 1, the shipping carton 10 of the present invention is shown in an exploded perspective view to illustrate its various components. The carton 10 includes a plurality of generally rectangular panels 12 which, when connected by hinge means 14, comprise a collapsible sidewall 16. One or more of the collapsible sidewalls 16 can be combined to define a box-like structure having an open top portion 18 and an open bottom portion 20. A lower support tray 22 is provided to receive the bottom portion 20 of the sidewall 16, and an upper support tray 24 is provided to receive the top portion 18 of the sidewall.

The lower support tray 22 includes a lower panel member 26 having an inside surface and a set of lower side members 28 which extend in the same direction at right angles from the inside surface about the perimeter of the lower panel member 26. The upper support tray 24 includes a similar upper panel member 30 and upper side members 32. The function of the support trays 22 and 24 is to enclose the sidewall 16 and to provide support for the assembled shipping carton 10. Thus, each support tray is made from a good strength, low cost material. A suitable low cost material has been found to be a sheet of corrugated cardboard having folded edges secured by stapled seams to define the side members 28 or 32.

Also referring to FIG. 3, a plurality of spaced-apart inserts 34 in the form of elongate members having a pair of opposed, generally flat surfaces is provided within the lower support tray 22 and the upper support tray 24. In particular, a first surface (not shown) of an insert 34 is firmly secured to the inside surface of the lower or upper support tray. The second surface 36 of the insert 34 includes an adhesive means, preferably with a removable backing layer. A lower or upper liner member 38 or 40 can be removably placed within the lower or upper support tray, respectively, and can be held in position against the second surface 36 of each insert 34 by the adhesive means. Preferably, the liner members 38 and 40 are retained by the respective support trays such that a channel is defined about the circumference of the liner member between the member and the tray side members. This channel preferably has a width equal to the thickness of the rectangular panels 12. Accordingly, the dimensions of the liner members 38 and 40 are such that they are positioned within the space defined by the sidewall 16. This provides improved structural support for the carton as a whole and improved insulation for the carton.

FIG. 2 shows a preferred embodiment of the collapsible sidewall 16 which includes two generally rectangular panels 12 connected by hinge means 14. When the two generally rectangular panels 12 are oriented at right angles from each other, a generally L-shaped collapsible sidewall 16 is provided. A pair of L-shaped collapsible sidewalls 16 positioned in an opposed relationship forms a generally rectangular-shaped carton, referred to herein as a box-like structure, having the open top portion 18 and open bottom portion 20. As used herein, the term "rectangular" includes rectangular-shaped and square-shaped configurations.

As an alternative embodiment, four L-shaped collapsible sidewalls may be arranged in a box-like structure by placing the four hinge means at the vertices of the carton. The portions of the sidewalls extending from two adjacent hinge means are joined to form the face of the carton between the adjacent hinge means. The joint between the L-shaped sidewall portions can then be in the center of the face and the joint can be covered by a suitable seal such as aluminum tape.

This particular embodiment provides additional structural support at the corners of the carton by moving the joints to the sides of the carton instead of the corners. This design is also useful where a large carton, one to two meters on a side, is being made.

In a still further alternative embodiment of the collapsible sidewall 16, four generally rectangular panels 12 are connected in series by hinge means 14 so that the collapsible sidewall 16 is foldable and only two ends of the rectangular panels 12 are not connected to an adjacent panel. In this embodiment, the four connected rectangular panels 12 can be positioned at right angles from the adjacent rectangular panels 12 to form the foregoing box-like structure which has the open top and bottom portions. In this embodiment, however, only one of the joints of the rectangular panels 12 in the box-like structure is not connected by hinge means 14. A suitable seal such as aluminum tape is used to seal this last joint. It is preferred to minimize the number of joints to be sealed by tape, thereby providing improved insulation.

Each rectangular panel 12 includes an exterior surface 42, an interior surface 44 and a filler portion 46 which connects the exterior surface 42 to the interior surface 44. Because the exterior surface 42 of the rectangular panel 12 serves as the exterior of the shipping carton 10, the exterior surface must be made from a material that is suitable for exterior use. The material selected for the exterior surface can vary depending on the use of the shipping carton 10. For example, the exterior surface 42 can employ common packaging cardboard for use in a variety of situations if only standard external strength of the shipping carton 10 is required. Alternatively, if a high degree of insulation is needed, the exterior surface 42 can be formed of an insulating material such as an expanded polystyrene foam or a layer of aluminum foil. Other suitable materials will be appreciated by those skilled in the art.

Because the interior surface 44 of the rectangular panel 12 acts as the interior of the shipping carton 10, it should be made from a suitable interior material, which will depend on the use of the shipping carton 10. If highly sensitive material is being packaged, the interior surface 44 can comprise a padded material. If a high degree of insulation is needed, an insulating material including expanded polystyrene foam or aluminum foil can be used. Placing a metal foil on both the interior surface 44 and exterior surface 42 provides improved insulation. If a damp material is being packaged, a suitable moisture resistant material such as a plastic film or coating can be selected. Other materials will once again be appreciated by those skilled in the art. The interior and exterior surfaces of the panels should, however, be resilient enough to resist denting and to distribute locally-applied loads to prevent crushing of the filler portion.

The filler portion 46 of the side panel 12 between the exterior surface 42 and the interior surface 44 adds strength and rigidity to the rectangular panel 12, and should also provide appropriate performance characteristics depending on the use of the shipping carton 10.

A good, low cost filler portion 46 has been found to be a honeycomb-type material. The honeycomb-type filler portion can be made from expandable kraft paper which is a good, low cost, lightweight material. Typical weights for the filler portion are 24 pounds per 1000 square feet of 1.0 inch thick honeycomb (12 kg per 100 square meters of 2.5 cm thick honeycomb). Other honeycomb materials will be apparent to those skilled in the art. If kraft paper or a similar material is used for the honeycomb-type filler portion, strength and water repellency can be enhanced by chemically treating the kraft paper with phenolic resins or other suitable reagents. In addition, the honeycomb filler can be made of an interior honeycomb core having a cell size of about 1.0 inches (2.5 cm). This provides great strength with a minimum amount of weight.

The honeycomb filler portion 46 can be attached to the interior surface 44 and exterior surface 42 by any suitable means. It has been found that use of an appropriate adhesive, such as MOR-AD 336 which is commercially available from Morton Chemical Company, provides a permanent, waterproof bond. The adhesive is preferably applied as a film or coating to the interior surface and exterior surface with the honeycomb filler portion 46 sandwiched therebetween. This provides a construction having both good shear and compression performance.

Other suitable materials for the filler portion 46 include expanded polystyrene foam which provides good insulating qualities. If a good degree of insulation and strength is needed, a honeycomb-type filler portion having its interior cells filled with a suitable insulating material can also be used. Other suitable tiller portions 46 will be appreciated by those skilled in the art.

A good, low cost embodiment of the hinge means 14 can be provided by extending both the exterior surface 42 and the interior surface 44 across the length of the adjacent generally rectangular panels 14 and crushing the filler portion 46 to form a foldable score line. Of course, other suitable hinge means 14 will be appreciated by those skilled in the art. Where the sidewalls 12 meet other than at a fold, a suitable seal such as aluminum tape is used to seal the sidewall 16.

Referring again to FIG. 1, the lower liner member 38 is removably positioned within the lower support tray 22 and the upper liner member 40 is removably positioned within the upper support tray 24. Like the rectangular panels 12, the liner members 38 and 40 each include a first surface 48 and a second surface 50 connected by a filler portion 52. This filler portion 52 can preferably be formed of the same material that is used to form the rectangular panels 12. The liner members 38 and 40 can preferably be dimensioned to fit within the open top portion 18 and open bottom portion 20 of the sidewall 16 so that the outermost surface of the lower liner member 38 and the upper liner member 40 is flush with the open bottom portion and the open top portion, respectively, of the box-like structure. Placing the liner members 38 and 40 inside the space defined by the sidewall 16 provides improved insulation and structural support.

As an alternative embodiment, lower or upper liner members 38 and 40 can be dimensioned to fit exactly within the lower and upper support trays 22 and 24. The sidewalls are either supported by the lower liner member 38 or support the upper liner member 40. In this embodiment, the liner members 38 and 40 will prevent crushing the contents of the carton as, for example, if stacked improperly during shipment. One variation is to have the lower liner member 38 fit within the sidewalls to provide support for the sidewalls while the upper liner member is dimensioned to fit on top of the sidewalls. This supports the sidewalls while preventing the upper liner member from falling inside the carton should the contents not fill the whole space.

Referring now to FIG. 3, an alternative embodiment of the lower support tray 22 is shown. In the preferred embodiment described herein, the lower support tray 22 and the upper support tray 24 are identical. Thus, only the lower support tray 22 of this embodiment will be described. The lower support tray 22 includes at least two spaced-apart inserts 34 positioned in a parallel relationship along the inside surface of the lower panel member 26 to provide an air space between the lower support tray 22 and the lower liner member 38. Three such inserts are preferred. As previously, indicated, each insert 34 comprises an elongate member having a pair of opposite generally flat surfaces. In this embodiment, the ends and sides of each insert 34 are spaced from the inside surface of each lower side member 28 by a distance at least as great as the thickness of a rectangular panel 12. This configuration defines a channel 54 that extends about the inside perimeter of the support tray between the inserts 34 and the side members 28. In this manner, the bottom portion 20 of the sidewall 16 is received within the channel 54 of the lower support tray 22 to more firmly secure the sidewall and the lower support tray together. A similar construction of the upper support tray 24 can be used to more firmly join the upper support tray to the top portion 18 of the sidewall 16.

Figure 4:
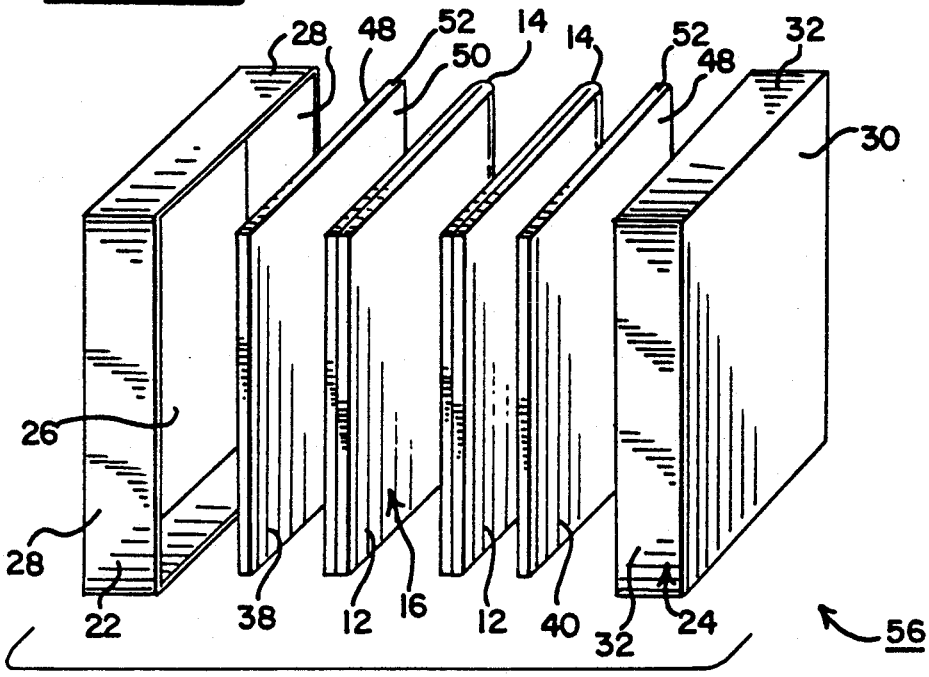
FIG. 4 is an exploded perspective view of a packaging kit according to the present invention.

Referring now to FIG. 4, a representative embodiment of a packaging kit 56 of the present invention is shown. In this embodiment, the collapsible sidewall 16 is folded at the hinge means 14 so that the rectangular panels 12 can be stored as a flat unit. The two support trays 22 and 24 are placed opposite each other to form an exterior shell of the packaging kit 56. The dimensions of the rectangular panels 12 are preferably somewhat less than the corresponding dimensions of panel members 26 and 30 of the support trays 22 and 24. Thus, when the sidewall 16 is folded around the hinge means 14 to provide a flat configuration as shown in FIG. 3, the rectangular panels 12 fit within the support trays 22 and 24.

In addition, as previously discussed, the lower liner member 28 and the upper liner member 40 are dimensioned to fit within the support trays 22 and 24 when the shipping carton 10 is assembled. Thus, the folded collapsible sidewall 16 and the liner members 38 and 40 can be received within the shell formed by the two support trays 22 and 24. The resulting kit, which can be about one-third the size of the assembled shipping carton 10, can- be efficiently stored and transported in an unassembled form.

Figure 5:
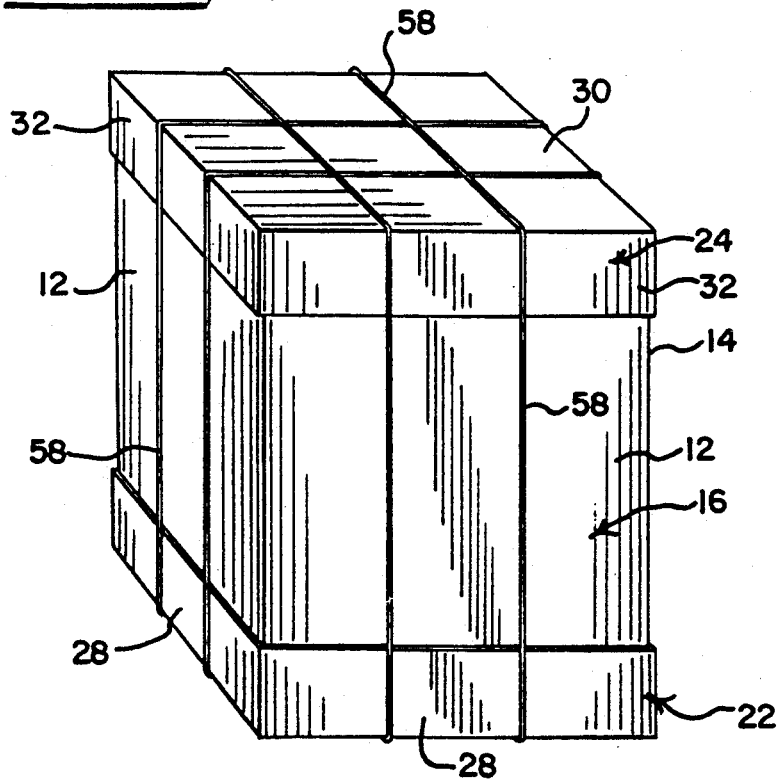
FIG. 5 is perspective view of the assembled carton of FIG. 1.

Referring to FIG. 1 in conjunction with FIG. 3, assembly of the present invention is accomplished as follows. If the upper support tray 24 includes the preferred embodiment of the spaced-apart inserts 34 with adhesive means on the second surface 36 thereof, the shipping carton is assembled by extending the panels 12 at right angles to each other to form the sidewall 16 and temporarily placing the top portion 18 of the collapsible sidewall 16 within the upper support tray 24 to ensure a proper fit. The upper liner member 40 is then secured to the spaced-apart inserts 34 within the upper support tray by the adhesive means. The lower support tray 22 is assembled following the same procedure whereby the bottom portion 20 of the collapsible sidewall 16 is extended and placed within the lower support tray and the lower liner member 38 is secured to the spaced-apart inserts 34 within the lower support tray by the adhesive means. The previously-assembled upper support tray 24 is then placed over the collapsible sidewall 16 to complete assembly of the shipping carton 10 shown in FIG. 5. The carton can be filled and secured by means including adhesive tape that connects the unhinged portions between adjacent panels 12 of the sidewall 16. In addition, banding or strapping 58 can be used to secure the carton before shipment. A cold source such as dry ice or a frozen cold-pack as known in the art can be placed in the carton to keep the inside of the carton cool during shipment.

It should be understood that various modifications, changes and variations may be made in the arrangement, operation and details of construction of the elements disclosed herein without departing from the spirit and scope of the invention.

What is claimed is:

1. A collapsible shipping carton comprising:

a plurality of generally rectangular panels, each panel being connected to the at least one adjacent panel by hinge means whereby each panel can be positioned at a right angle to an adjacent panel to form a sidewall having an open top portion and an open bottom portion;

an upper support tray and a lower support tray each including a panel member having an inside surface and side members which extend from the inside surface whereby the upper support tray receives the top portion of the sidewall and the lower support tray receives the bottom portion of the sidewall to enclose the sidewall;

a liner member removably associated with the inside surface of the lower support tray wherein the liner member is separated from the side members of the lower support tray to define a channel adapted to receive the bottom portion of the sidewall; and a second liner member removably associated with the inside surface of the upper support tray, the second liner member being dimensioned to fit over the top portion of the sidewall and be supported thereby.

2. The shipping carton according to claim 1 wherein the lower support tray includes a plurality of spaced-apart inserts, each insert having a first surface associated with the inside surface of the lower support tray and a second surface associated with the liner member, the second surface of each insert including adhesive means for removably securing the liner member to the insert.

3. The shipping carton according to claim 2 wherein the adhesive means includes a removable backing layer.

4. The shipping carton according to claim 1 wherein the upper support tray includes a plurality of spaced-apart inserts, each insert having a first surface associated with the inside surface of the upper support tray and a second surface associated with the second liner member, the second surface of each insert including adhesive means for securing the second liner member to the insert.

5. The shipping carton according to claim 4 wherein the adhesive means includes a removable backing layer.

6. The shipping carton according to claim 2 wherein each insert of the lower support tray is separated from the side members of the tray to define a channel adapted to receive the bottom portion of the sidewall.

7. The shipping carton according to claim 6 wherein the channel is at least as thick as a panel of the sidewall.

8. The shipping carton according to claim 4 wherein each insert of the upper support tray is separated from the side members of the tray to define a channel adapted to receive the top portion of the sidewall.

9. The shipping carton according to claim 8 wherein the channel is at least as thick as a panel of the sidewall.

10. The shipping carton according to claim 1 including means for securing the panels and the support trays together in a box-like structure.

11. The shipping carton according to claim 1 wherein the securing means includes means for connecting the adjacent panels together.

12. The shipping carton according to claim 1 wherein each panel includes an interior surface, an exterior surface and a filler portion therebetween.

13. The shipping carton according to claim 12 wherein the interior and exterior surfaces include a layer of metal foil.

14. The shipping carton according to claim 12 wherein the filler portion is a honeycomb-type material.

15. The shipping carton according to claim 12 wherein the filler portion is an insulating material.

16. The shipping carton according to claim 15 wherein the filler portion comprises an expanded polystyrene foam.

17. The shipping carton according to claim 15 wherein the panels consist of a honeycomb-type filler portion and an insulating material.

18. The shipping carton according to claim 1 wherein the support trays comprise cardboard.

19. A shipping carton comprising:

a) a lower support tray including a lower panel member having an inside surface and a plurality of lower side members that extend from the inside surface;

b) a plurality of generally rectangular panels, each panel being connected to the adjacent panels to form a sidewall having a top portion and a bottom portion, the bottom portion being adapted to be received within the lower support tray, the dimensions of the panels being less than the corresponding dimensions of the lower panel member, the panels being received within the lower support tray for storage;

c) an upper support tray comprising an upper panel member having an inside surface and a plurality of upper side members that extend from the inside surface whereby the upper support tray is adapted to receive the top portion of the sidewall, the upper support tray and the lower support tray comprising corrugated cardboard;

d) at least one liner member associated with the inside surface of one of the support trays, the dimensions of the at least one liner member being less than the corresponding dimensions of the lower panel member, the at least one liner member thus being received within the lower support tray, wherein the liner member and each of the plurality of panels further include an interior surface, an exterior surface and a filler portion and the interior and exterior surfaces include a layer of metal foil and the filler portion comprises an expandable kraft paper honeycomb-type material, wherein the panels are connected by a crushed section of the expandable kraft paper honeycomb-type filler portion located between the adjacent panels.

20. The shipping carton according to claim 19 wherein the liner member is associated with the inside surface of the lower support tray and the liner member is separated from the side members of the tray to define a channel adapted to receive the bottom portion of the sidewall.

21. The shipping carton according to claim 20 including a second liner member associated with the inside surface of the upper support tray, the second liner member being dimensioned to fit over the top portion of the sidewall to be supported thereby.

22. The shipping carton according to claim 19 wherein the lower support tray includes a plurality of spaced-apart inserts and the liner member, each insert having a first surface associated with the inside surface of the lower support tray and a second surface associated with the liner member, the second surface of each insert including adhesive means for removably securing the liner member to the insert.

23. The shipping carton according to claim 22 wherein the adhesive means includes a removable backing layer.

24. The shipping carton according to claim 19 wherein the upper support tray includes a plurality of spaced-apart inserts and the liner member, each insert having a first surface associated with the inside surface of the upper support tray and a second surface associated with the liner member, the second surface of each insert including adhesive means for securing the liner member to the insert.

25. The shipping carton according to claim 24 wherein the adhesive means includes a removable backing layer.

26. The shipping carton according to claim 22 wherein each insert of the lower support tray is separated from the side members of the tray to define a channel adapted to receive the bottom portion of the sidewall.

27. The shipping carton according to claim 26 wherein the channel is at least as thick as a panel of the sidewall.

28. The shipping carton according to claim 24 wherein each insert of the upper support tray is separated from the side members of the tray to define a channel adapted to receive the top portion of the sidewall.

29. The shipping carton according to claim 28 wherein the channel is at least as thick as a panel of the sidewall.

30. A method of forming a shipping carton comprising the steps of:

providing a plurality of generally rectangular panels, each panel having a bottom portion and a top portion and being connected to the at least one adjacent panel by hinge means;

providing a lower support tray having a lower panel member and a plurality of lower side members extending from the lower panel member, with each lower side member corresponding to the bottom portion of at least one of the panels;

arranging each generally rectangular panel at a right angle to one adjacent panel within the first support tray to form a sidewall;

associating a liner member with the inside surface of the lower support tray;

separating the liner member from the side members of the lower support tray to define a channel adapted to receive the bottom portion of the sidewall;

providing an upper support tray having an upper panel member and a plurality of upper side members extending from the upper panel member, with each upper side member corresponding to the top portion of at least one of the panels to cover the sidewall and form the shipping carton;

associating a second liner member with the inside surface of the upper support tray;

dimensioning the second liner member to fit over the top portion of the sidewall and be supported thereby; and securing the support trays and panels together.

31. A packaging kit having component parts capable of being assembled to form a shipping carton comprising:

a plurality of generally rectangular panels, each panel being connected to the at least one adjacent panel by hinge means, the panels being adapted to be expanded to form a sidewall having an open top portion and an open bottom portion;

an upper support tray and a lower support tray, each support tray including a panel member having an inside surface and side members which extend from the inside surface whereby the lower support tray receives the bottom portion of the sidewall and the upper support tray receives the top portion of the sidewalls to form the shipping carton;

a liner member associated with the inside surface of the lower support tray and a second liner member associated with the inside surface of the upper support tray, the second liner member being dimensioned to fit over the top portion of the sidewall and be supported thereby, wherein the liner member and the second liner member and each of the plurality of panels include an interior surface, an exterior surface and a filler portion and the interior and exterior surfaces include a layer of metal foil and the filler portion comprises an expandable kraft paper honeycomb-type material; and the dimensions of the rectangular panels, the liner member and the second liner member being less than the corresponding dimensions of the panel members and the panels are folded at the hinge means for insertion and storage within either support tray.

32. The packaging kit according to claim 31 wherein the liner member is separated from the side members of the lower support tray to define a channel adapted to receive the bottom portion of the sidewall.

33. The packaging kit according to claim 31 wherein the lower support tray includes a plurality of spaced-apart inserts, each insert having a first surface associated with the inside surface of the lower support tray and a second surface associated with the liner member, the second surface of each insert including adhesive means for removably securing the liner member to the insert.

34. The packaging kit according to claim 33 wherein the adhesive means includes a removable backing layer.

35. The packaging kit according to claim 31 wherein the upper support tray includes a plurality of spaced-apart inserts, each insert having a first surface associated with the inside surface of the upper support tray and a second surface associated with the second liner member, the second surface of each insert including adhesive means for securing the second liner member to the insert.

36. The packaging kit according to claim 35 wherein the adhesive means includes a removable backing layer.

37. The packaging kit according to claim 33 wherein each insert of the lower support tray is separated from the side members or the tray to define a channel adapted to receive the bottom portion of the sidewall.

38. The packaging kit according to claim 37 wherein the channel is at least as thick as the panel of the sidewall.

39. The packaging kit according to claim 25 wherein each insert of the upper support tray is separated from the side members of the tray to define a channel adapted to receive the top portion of the sidewall.

40. The packaging kit according to claim 39 wherein the channel is at least as thick as the panel of the sidewall.

41. The packaging kit according to claim 31 including means for securing the shipping carton together.

42. A shipping carton assembled from the packaging kit of claim 31.

43. A shipping carton comprising:

a) a lower support tray including a lower panel member having an inside surface and a plurality of lower side members that extend from the inside surface, the lower support tray including a plurality of spaced-apart inserts and a liner member associated with the inside surface of the lower support tray, each insert having a first surface associated with the inside surface of the lower support tray and a second surface associated with the liner member, the second surface of each insert including adhesive means for removably securing the liner member to the insert;

b) a plurality of generally rectangular panels, each panel being connected to the adjacent panels to form a sidewall having a top portion and a bottom portion, the bottom portion being adapted to be received within the lower support tray; and c) an upper support tray comprising an upper panel member having an inside surface and a plurality of upper side members that extend from the inside surface whereby the upper support tray is adapted to receive the top portion of the sidewall, the upper support tray including a plurality of spaced-apart inserts and a second liner member, each insert having a first surface associated with the inside surface of the upper support tray and a second surface associated with the second liner member, the second surface of each insert including adhesive means for securing the second liner member to the insert.

44. A collapsible shipping carton comprising:

a plurality of generally rectangular panels, each panel being connected to the at least one adjacent panel by hinge means whereby each panel can be positioned at a right angle to an adjacent panel to form a sidewall having an open top portion and an open bottom portion;

an upper support tray and a lower support tray each including a panel member having an inside surface and side members which extend from the inside surface whereby the upper support tray receives the top portion of the sidewall and the lower support tray receives the bottom portion of the sidewall to enclose the sidewall;

at least one liner member removably associated with the inside surface of one of the support trays; and adhesive means for removably securing the at least one liner member to the one of the support trays.

45. The shipping carton according to claim 44 wherein the adhesive means includes a removable backing layer.

46. The shipping carton according to claim 44 having two liner members, a liner member associated with the lower support tray and a second liner member associated with the upper support tray.

47. The shipping carton of claim 46 wherein the liner member is separated from the side members of the lower support tray to define a channel adapted to receive the bottom portion of the sidewall and the second liner member is dimensional to fit over the top portion of the sidewall and be supported thereby.

* * * * *

UNITED STATES PATENT AND TRADEMARK OFFICE

CERTIFICATE OF CORRECTION

PATENT NO. : 5,215,248

DATED : June 1, 1993

INVENTOR(S) : Paul Moser

It is certified that error appears in the above-indentified patent and that said Letters Patent is hereby corrected as shown below:

Column 5, line 12, change "tiller" to --filler--.

Column 6, line 36, change "can-be" to --can be--.

Column 10, Claim 39, line 1, change "25" to --35--.

Signed and Sealed this

Nineteenth Day of July, 1994

*Attest:*

*Attesting Officer*

BRUCE LEHMAN

*Commissioner of Patents and Trademarks*